US010519627B2

(12) United States Patent
Ge

(10) Patent No.: US 10,519,627 B2
(45) Date of Patent: Dec. 31, 2019

(54) PULL-SLIP CONTROL SYSTEM FOR TRACK-TYPE TRACTOR AND TRACK-TYPE TRACTOR OPERATING METHOD

(71) Applicant: Caterpillar Inc., Peoria, IL (US)

(72) Inventor: Xinyu Ge, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 404 days.

(21) Appl. No.: 15/427,627

(22) Filed: Feb. 8, 2017

(65) Prior Publication Data

US 2018/0223501 A1 Aug. 9, 2018

(51) Int. Cl.

| | |
|---|---|
| ***E02F 9/20*** | (2006.01) |
| ***E02F 3/84*** | (2006.01) |
| ***E02F 9/22*** | (2006.01) |
| ***E02F 3/76*** | (2006.01) |
| ***E02F 3/815*** | (2006.01) |

(52) U.S. Cl.

CPC ..... *E02F 9/2029* (2013.01); *E02F 3/7604* (2013.01); *E02F 3/84* (2013.01); *E02F 3/844* (2013.01)

(58) Field of Classification Search

CPC ..... A01B 63/112; A01B 63/145; A01B 51/00; A01B 59/042; A01B 63/1115; A01B 73/00; A01B 73/065; B60W 2300/17; B60W 2520/26; B60W 50/14; B60W 2050/0031; B60W 2300/152; B60W 2300/44; B60W 2510/1005; B60W 2520/10; B60W 2720/10; B60W 30/18036; B60W 50/0098; G07C 5/0841; B60G 2300/082; B60R 9/00; B60R 9/06; B60Y 2200/41; B62D 49/00; B62D 49/0635; B62D 49/065; E02F 3/7604; E02F 5/32; E02F 9/2029; G01L 5/16

See application file for complete search history.

(56) References Cited

U.S. PATENT DOCUMENTS

| | | | | |
|---|---|---|---|---|
| 6,035,249 | A | 3/2000 | Yamamoto et al. | |
| 7,677,323 | B2 | 3/2010 | Stratton et al. | |
| 8,401,751 | B2 | 3/2013 | Jacobson et al. | |
| 8,983,739 | B2 | 3/2015 | Faivre | |
| 9,002,593 | B2 | 4/2015 | Clar et al. | |
| 9,086,698 | B2 | 7/2015 | Faivre et al. | |
| 2014/0156153 | A1* | 6/2014 | Faivre | G07C 5/0841 701/50 |
| 2014/0336881 | A1* | 11/2014 | Clar | E02F 9/2045 701/50 |
| 2015/0236752 | A1 | 8/2015 | Cruz et al. | |
| 2016/0057004 | A1 | 2/2016 | Ge | |
| 2016/0194854 | A1 | 7/2016 | Yamazaki et al. | |

FOREIGN PATENT DOCUMENTS

| | | |
|---|---|---|
| JP | H04161528 A | 6/1992 |

* cited by examiner

*Primary Examiner* — Hussein Elchanti
*Assistant Examiner* — Paul A Castro
(74) *Attorney, Agent, or Firm* — Jonathan F. Yates

(57) ABSTRACT

Operating a tractor with a front ground-engaging implement and a back ground-engaging implement includes calculating an error between a real-time pull-slip ratio and a target pull-slip ratio, and engaging the back ground-engaging implement with material of an underlying substrate to reduce the error. Related hardware and control logic are also disclosed.

14 Claims, 4 Drawing Sheets

PULL-SLIP CONTROL SYSTEM FOR TRACK-TYPE TRACTOR AND TRACK-TYPE TRACTOR OPERATING METHOD

TECHNICAL FIELD

The present disclosure relates generally to pull-slip control in a tractor, and more particularly to reducing a pull-slip ratio error by way of selectively engaging a back ground-engaging implement of the tractor with material of an underlying substrate.

BACKGROUND

Tractors such as track-type tractors are used in a great many different operations, ranging from pushing loose material or debris about a worksite to grading, production dozing or scraping where materials are dug from a substrate, and still other applications related to site preparation, forestry, mining, and general civil engineering. Track-type tractors offer the advantage of a rugged build and substantial capacity for drawbar pull and traction in challenging underfoot conditions, steep terrain, and when towing or pushing large loads.

Due to the nature of the service environment within which track-type tractors operate, the tracks typically experience some slip relative to the underlying substrate. It has been discovered that the extent of track slip in relation to drawbar pull affects operating efficiency of the track-type tractor. If a track-type tractor is experiencing close to 100% track slip, then the track-type tractor is not presently traveling and therefore not likely moving any material or otherwise performing any useful work. On the other hand, if the track-type tractor is experiencing close to 0% track slip the track-type tractor may be traveling but is likely not moving any load apart from the tractor's own weight. Along a so-called pull-slip curve between 100% slip and 0% slip there is a window or zone of greatest efficiency. Different pull-slip curves may be applied to different machine conditions or different service conditions, with the idea that certain machine or operating parameters can be varied in real time to cause the track-type tractor to operate as efficiently as is practicable. U.S. Pat. No. 8,983,739 to Faivre discloses real-time pull-slip curve modeling based upon information as to soil conditions. Establishing an accurate, real-time pull-slip curve theoretically enables an operator or autonomous controller to vary machine parameters, such as track speed, more effectively to achieve efficiency or other aims. Despite advancements taught by Faivre and others, there remains ample room for advancement in controls technology for track-type tractors and related implements.

SUMMARY OF THE INVENTION

In one aspect, a method of operating a tractor having a hydraulically actuated implement system includes receiving data indicative of a pull-slip ratio of a tractor during traversing a substrate with at least one of a front ground-engaging implement or a back ground-engaging implement of the hydraulically actuated implement system engaged with material of the substrate. The method further includes calculating an error between the pull-slip ratio indicated by the data and a target pull-slip ratio, and commanding engagement of the back ground-engaging implement with the material of the substrate to reduce the error between the pull-slip ratio indicated by the data and the desired pull-slip ratio.

In another aspect, a tractor includes a frame, and ground-engaging elements coupled to the frame. A hydraulically actuated implement system of the tractor includes a front ground-engaging implement, and a back ground-engaging implement. A pull-slip control system of the tractor includes a first sensing mechanism configured to monitor a drawbar pull parameter of the tractor, a second sensing mechanism configured to monitor a slip parameter of the tractor, and a control mechanism coupled with the hydraulically actuated implement system. The control mechanism is configured to compare a pull-slip ratio indicated by data produced from the first sensing mechanism and the second sensing mechanism with a target pull-slip ratio, and command engagement of the back ground-engaging implement with material of the substrate, such that an error between the pull-slip ratio indicated by the data and the target pull-slip ratio is reduced.

In still another aspect, a pull-slip control system for a tractor having a hydraulically actuated implement system with a front ground-engaging implement and a back ground-engaging implement includes a first sensing mechanism configured to monitor a drawbar pull parameter of the tractor, a second sensing mechanism configured to monitor a slip parameter of the tractor, and a control mechanism. The control mechanism is configured to receive data from each of the first sensing mechanism and the second sensing mechanism, and to determine a pull-slip ratio of the tractor based on the data received from the first sensing mechanism and the second sensing mechanism. The control mechanism is further configured to compare the determined pull-slip ratio with a target pull-slip ratio, and command engagement of the back ground-engaging implement with material of a substrate underlying the tractor, such that an error between the pull-slip ratio indicated by the data and the target pull-slip ratio is reduced.

DETAILED DESCRIPTION

Figure 1:
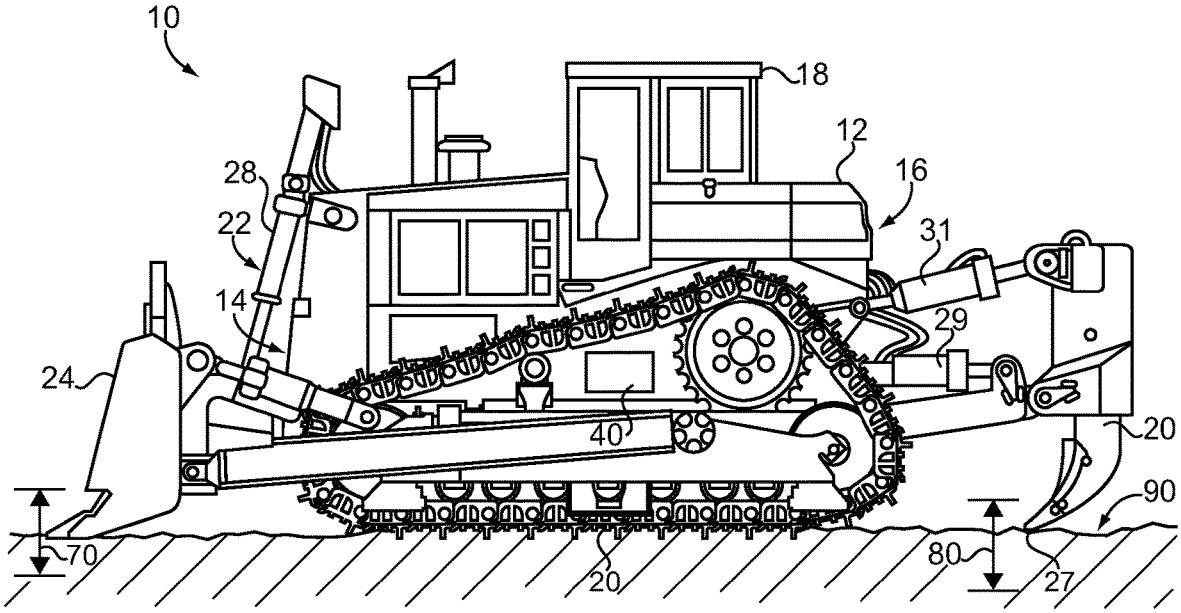
FIG. 1 is a side diagrammatic view of a tractor, according to one embodiment.

Referring to FIG. 1, there is shown a track-type tractor 10, according to an embodiment of the present disclosure. While track-type tractor 10 is illustrated as an example machine, the present disclosure may be applicable to other machines such as wheel tractors or other ground-engaging machines, and with ground-engaging elements other than tracks. As illustrated in FIG. 1, track-type tractor may include a tractor frame 12 having a front frame end 14 and a back frame end 16. An operator cab 18 is mounted between front frame end 14 and back frame end 16, and ground-engaging tracks 20, one of which is visible in the view of FIG. 1, are coupled to and support frame 12 in a generally conventional manner. Track-type tractor (hereinafter "tractor") 10 may be a relatively large and heavy duty track-type tractor, where ground-engaging tracks 20 are arranged in a high drive configuration, with a drive sprocket (not numbered) positioned at a location vertically higher than front and back idler gears (not numbered). However, the present disclosure is not limited to the high drive configuration. Track-type tractor 10 further includes a hydraulically actuated implement system 22 including a front ground-engaging implement 24 mounted at or toward front frame end 14, and a back ground-engaging implement 26 mounted at or toward back frame end 16. The terms "front" and "back" are used herein in relation to each other, and should not necessarily be taken to mean something is closer or further from the front or back of the machine. One or more hydraulic actuators 28 are provided to raise and lower front ground-engaging implement 24. Various additional hydraulic actuators may be provided for tilting front ground-engaging implement 24, pivoting front ground-engaging implement 24 about a vertical axis, or performing various other adjustments.

In the illustrated embodiment, front ground-engaging implement (hereinafter "implement") 24 is shown in the context of a known dozing blade of a type suitable for production dozing, however, the present disclosure is not thereby limited. Another hydraulic actuator(s) 29 may be provided for raising and lowering back ground-engaging implement (hereinafter "implement") 26, and yet another hydraulic actuator(s) 31 provided for pivoting implement 26 about a horizontal axis. Other hydraulic actuators could also be provided for varying a position or orientation of implement 26 in three-dimensional space according to additional degrees of freedom. In the illustrated embodiment implement 26 includes a ripper, oriented so as to penetrate a tip 27 into material of a substrate 90. Those skilled in the art will be familiar with conventional applications for a ripper mounted upon a track-type tractor, including cutting and/or fracturing soil, aggregate, or other types of substrate materials. Other types of back ground-engaging implements such as blades, claws, discs, plows, or the like might alternatively be used. In the illustrated embodiment, a height of implement 24 can be adjusted in a vertical range generally referred to in the art as grade and shown by way of arrow 70 in FIG. 1. Implement 26 can analogously be adjusted in a grade range shown by way of arrow 80 in FIG. 1. It should be appreciated that each of implement 24 and implement 26 can be adjusted between an elevated position vertically above a surface of a horizontal underlying substrate and a second position vertically below a surface of a horizontal underlying substrate, the significance of which will be further apparent from the following description.

Tractor 10 may further be equipped with a pull-slip control system 40 that is a part of or otherwise coupled with certain of the components of hydraulically actuated implement system 22. As further discussed herein, pull-slip control system (hereinafter "control system") 40 is configured to receive and gather data relating to present or anticipated operating conditions or operating state of tractor 10, and exploit such data for purposes relating to optimizing efficiency to a particular task. It is contemplated that tractor 10 may be manually operated or autonomously operated, or operated such that certain tasks relating to control of hydraulically actuated implement system 22 are performed autonomously by control system 40.

Figure 2:
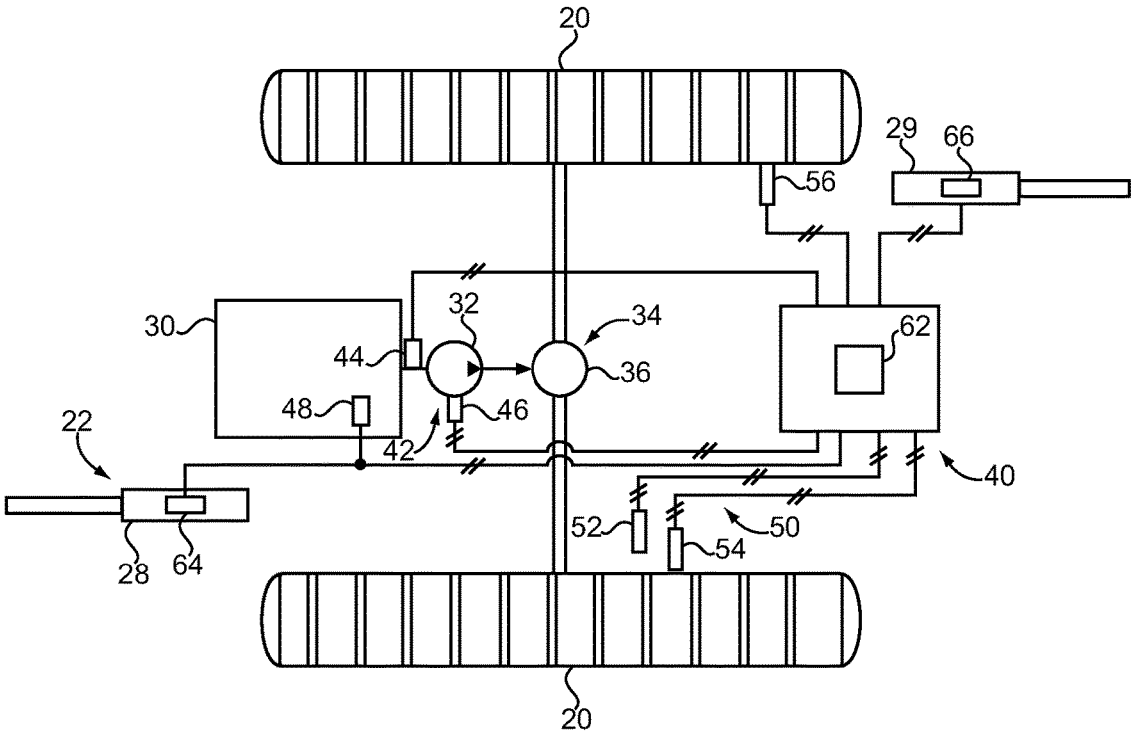
FIG. 2 is a schematic illustration of parts of the tractor of FIG. 1, including a pull-slip control system, according to one embodiment.

Referring now to FIG. 2, there are shown features of pull-slip control system 40 and tractor 10 in further detail. In an embodiment, an engine 30 such as a compression ignition internal combustion engine, a transmission 32, and a final drive 34 including components such as a differential and drive axles, and/or one or more motors 36 together comprise a powertrain system of tractor 10. Transmission 32 might include a hydrostatic transmission having a conventional pump and motor arrangement, a mechanical transmission, or a hybrid hydromechanical transmission, an electric motor drive, or some other arrangement. It should also be appreciated that transmission 32 will typically include at least two gear ranges or gear ratios for forward travel, and at least one reverse gear range or gear ratio. It will further be appreciated that engine 30 will, by way of transmission 32, provide rotational power to tracks 20 in a generally known manner for not only forward propulsion and reverse propulsion but also for steering.

Also shown in FIG. 2 are additional elements of pull-slip control system 40, including a first sensing mechanism 42 configured to monitor a drawbar pull parameter of tractor 10. The drawbar pull parameter may be or be indicative of a drawbar pull force exerted by tractor 10 during operation. It will be appreciated by those of skill in the art that drawbar pull is not typically measured directly, but can be estimated or inferred from measuring or observing one or more other factors having known relationships with drawbar pull. For instance, the drawbar pull parameter might be a value (e.g. a numerical parameter) indicative of drawbar pull force that is monitored or determined by observing such factors as engine output power, transmission gear ratio, track coefficient of traction and/or various other parameters. To such ends, first sensing mechanism 42 may include a first sensor 44 that senses engine speed or transmission input shaft speed, a second sensor 46 that senses transmission gear ratio, and a third sensor 48 that senses engine fueling or throttle position. Additional or alternative strategies, including monitoring a torque output of engine 30 directly or at a torque converter, or in the case of a hydrostatic transmission monitoring hydraulic pressure, can be used in determining, estimating, or inferring a drawbar pull parameter that is indicative of a drawbar pull force of tractor 10.

Control system 40 further includes a second sensing mechanism 50 configured to monitor a track slip parameter of tractor 10. Second sensing mechanism 50 may include a first sensor 52 configured to monitor a ground speed of tractor 10, a second sensor 54 configured to monitor a track speed of a first one of ground-engaging tracks 20, and a third sensor 56 configured to monitor a track speed of another one of ground-engaging tracks 20. Comparisons of ground speed with track speed can be used to determine track slip. Other known techniques could be applied as well. Control system 40 further includes a control mechanism 60 that includes at least one computing device 62 such as a processor, microcontroller, etc., that is coupled with hydraulically actuated implement system 22 and also coupled with each of first sensing mechanism 42 and second sensing mechanism 50 to receive data produced from first sensing mechanism 42 and second sensing mechanism 50.

Also shown in FIG. 2 is a first position sensor 64 coupled with hydraulic actuator 28 and a second position sensor 66 coupled with hydraulic actuator 29. Control mechanism 60 may be coupled with each of first position sensor 64 and second position sensor 66 to receive data indicative of a position of the corresponding hydraulic actuator 28 or 29. The position of the subject hydraulic actuator will typically have a known relationship to a position or grade of implement 24 or implement 26 within the corresponding range 70 or 80, respectively. Control mechanism 60 may further be in communication with other components of hydraulically actuated implement system 22, such as control valve assemblies and the like (not shown), such that control mechanism 60 can vary a grade of implement system 24 and a grade of implement system 26 in a closed-loop manner. It should be appreciated that the described control strategy for controlling and varying the grade of implement 24 or the grade of implement 26 is exemplary only, and with different implement types or different hydraulic system architectures or arrangements, various expanded or alternative techniques could be used for controlling grades of the respective implements.

As noted above, control mechanism 60 is configured to receive data from each of first sensing mechanism 42 and second sensing mechanism 50. Control mechanism 60 may be further configured to determine a pull-slip ratio of tractor 10 based on the data received from first sensing mechanism 42 and second sensing mechanism 50. Control mechanism 60 may be still further configured to calculate an error between the pull-slip ratio indicated by the data and a target pull-slip ratio. Calculating a difference between numerical ratios to determine an error term is a routine mathematical operation. Control mechanism 60 may also be configured to command engagement of implement 26 with material of an underlying substrate that tractor 10 is traversing while at least one of implement 24 and 26 is engaging material of the substrate, such that the error is reduced. Another way to understand these principles is that control mechanism 60, while tractor 10 is traversing a substrate and one or both of implement 24 and implement 26 is engaged with material of the substrate, can initiate engagement of implement 26 or change a pattern of engagement of implement 26, with the substrate to reduce the error in the pull-slip ratio. In one further embodiment, the data includes an expected pull-slip ratio, and the engagement of implement 26, such as dropping of implement 16 into engagement, with the material of the substrate may be initiated prior to occurrence of the expected pull-slip ratio.

Those skilled in the art will appreciate that operating efficiency can vary relatively dramatically where a track-type tractor is operating outside of a relatively narrow window or region along an optimum pull-slip curve. By exploiting the capability of implement 26 to reduce the error, efficiency can be improved over alternative strategies. As noted above, tractor 10 may be operated in the usual course to traverse a substrate with one or both of implement 24 and implement 26 engaged with material of the substrate. It is contemplated that control mechanism 60 can be used to command engagement of implement 26 by commanding dropping implement 26 into engagement with the material of the substrate to reduce an effective drawbar pull force of tractor 10, thus reducing the error. It is also contemplated that control mechanism 60 can command a change in a pattern of engagement of implement 26 with material of the substrate, such as commanding varying a depth of penetration of implement 26.

Figure 3:
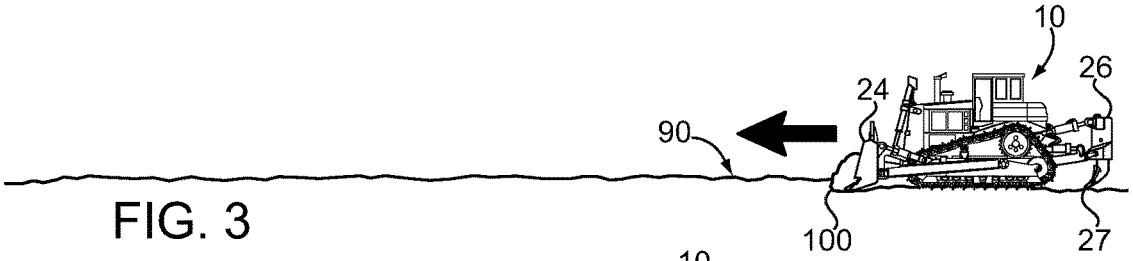
FIG. 3 is a diagrammatic view of a tractor in a load phase of a work cycle, according to one embodiment.
Figure 4:
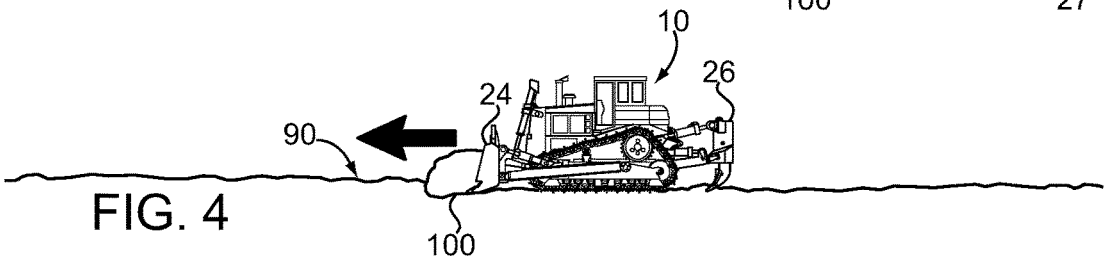
FIG. 4 is a diagrammatic view of a tractor in a carry phase of the work cycle.
Figure 5:
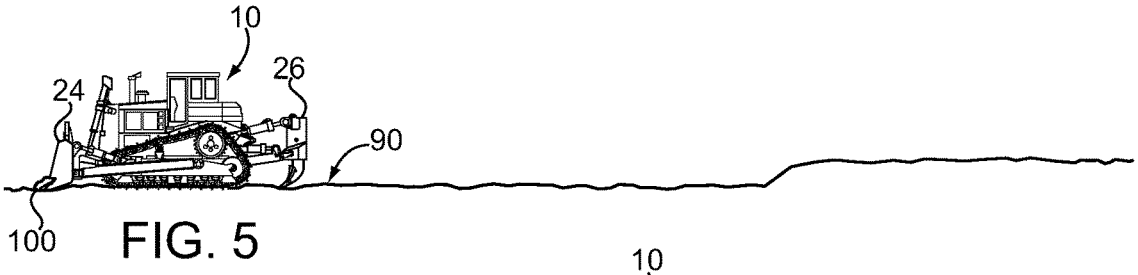
FIG. 5 is a diagrammatic view of a tractor at a spread phase of the work cycle.
Figure 6:
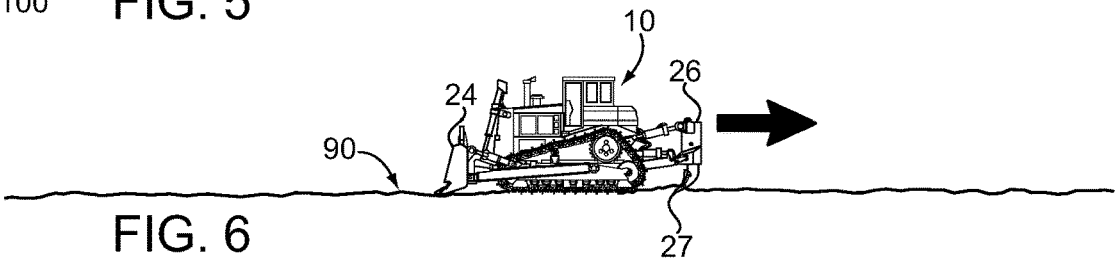
FIG. 6 is a diagrammatic view of a tractor at a return phase of the work cycle.

Referring now to FIG. 3, there is shown tractor 10 as it might appear traversing a substrate 90 and during a loading phase of a load, carry, spread, and return work cycle. In FIG. 3, implement 24 is scraping or digging material from substrate 90, and may actually be positioned at a grade where implement 24 is slightly below a surface of substrate 90. Material 100 such as soil, rock, sand, gravel, ore, coal, et cetera, is accumulated in front of implement 24 as tractor 10 pushes forward. Implement 26 is elevated slightly such that tip 27 is vertically spaced above the surface of substrate 90. In FIG. 4, tractor 10 is shown as it might appear in a carry phase of the work cycle where more material 100 has accumulated in front of implement 24, and is being pushed across the surface of substrate 90 but not typically scraped or dug from the surface of substrate 90. In FIG. 5 tractor 10 has traversed further and is shown as it might appear having just completed a spread phase of the work cycle, where implement 24 has been increased in grade such that much of or all of material 100 has been distributed beneath implement 24. In FIG. 4 implement 24 has been raised slightly from the lowered position occupied in the loading phase depicted in FIG. 3. In FIG. 6 tractor 10 is shown as it might appear during a return phase of the work cycle where tractor 10 is traveling in reverse back to a location to begin the cycle again.

As noted above, in FIG. 4 tractor 10 is shown as it might appear transitioning from the load phase to the carry phase of the work cycle. When tractor 10 is transitioned from a state where material 100 is being scraped from substrate 90 to the carry phase where material 100 is merely being pushed across the surface of substrate 90 the power output requirements of tractor 10 will typically reduce relatively rapidly. It is also common for tractor 10 to be operated at the same transmission gear ratio through the transition. In other words, while the engine output power demand can drop substantially, transmission gear is typically maintained and track-type tractor 10 may be operated in the same one of a plurality of available transmission gears during each of the load phase and the carry phase of the work cycle. As a result, the reduced resistance to forward travel of tractor 10 can cause the effective drawbar pull force to decrease significantly and potentially cause overspeeding of engine 30 or having other undesired effects. By commanding engagement of implement 26, i.e. dropping the ripper, control mechanism 60 can limit overspeeding engine 30. When transitioning from the carry phase to the spread phase the engagement of implement 26 with material substrate 90 may be commanded to reverse, in other words control mechanism 60 may raise the ripper. It is contemplated that implement 26 may nevertheless commanded to engage with substrate 90, or change its engagement with substrate 90, during the carry phase, the spread phase, or during any type of operation in an altogether different work cycle.

Tractor 10, and more particularly control mechanism 60, may also be configured to gather data as to undercarriage surface conditions by operating tractor 10 to traverse substrate 90 with implement 26 lowered into engagement with material of substrate 90. In FIG. 6, tractor 10 is shown with implement 26 positioned such that tip 27 penetrates into substrate 90. During this return phase of the work cycle the effect that penetration of implement 26 into material of substrate 90 has on factors such as track slip and ground speed can be observed and recorded. The undercarriage surface conditions affect target pull-slip ratio, the significance of which will be further apparent from the following description.

As suggested above, still other instances where it is desirable to command initiating engagement or ceasing engagement of a back ground-engaging implement, or changing a pattern of engagement such as a depth of engagement, are contemplated beyond the exemplary work cycle described herein. For example, as a part of the work cycle depicted in FIGS. 3-6, or in a different work cycle, control mechanism 60 might command engagement of implement 26 with material of an underlying substrate so as to retard travel of tractor 10. Implement 26 might be commanded to engage with material of a substrate to retard tractor 10 in cooperation with or instead of applying a brake. It is further contemplated that implement 26 might be commanded to engage with material of a substrate during braking and data as to undercarriage conditions gathered based upon the relative extent to which engagement of implement 26 affects the distance or time required to stop or slow tractor 10.

INDUSTRIAL APPLICABILITY

Figure 7:
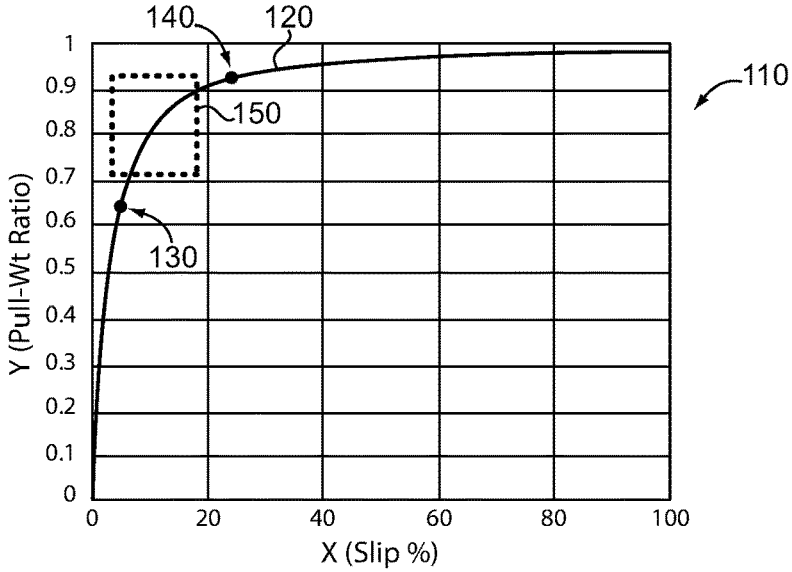
FIG. 7 is a graph of a pull-slip curve, according to one embodiment.

Referring now to FIG. 7, there is shown a graph 110 illustrating an example pull-slip curve 120 determined from a Pull-weight ratio of a track-type tractor on the Y-axis and a Slip % of tracks of the track-type tractor on the X-axis. As suggested above an operating window 150 exists on curve 120 that represents a range of optimal efficiency for tractor operation. Generally, although not necessarily, window 150 can encompass what might be understood as the "knee" of curve 120 where curve 120 transitions from a trajectory that is more vertically oriented to a trajectory that is more horizontally oriented. A first point 130 on curve 120 lies outside of window 150 and can be understood to correspond to a case where both Pull-Weight ratio and Slip % are relatively low, such as an operating scenario where the drawbar pull is a relatively small proportion of tractor weight and the tracks are not slipping very much. Another point 140 on curve 120 also lies outside of window 150 and can be understood to correspond to a case where both Pull-Weight ratio and Slip % are relatively high, such as an operating scenario where the drawbar pull is a relatively large proportion of tractor weight and the tracks are slipping relatively more. As discussed above the present disclosure enables reducing an error between an actual or apparent pull-slip ratio and a target pull-slip ratio in a track-type tractor. Accordingly, it will be appreciated that varying effective drawbar pull force can adjust an operating point along the pull-slip curve such as curve 120 toward a desired operating point within a window of highest efficiency.

Figure 8:
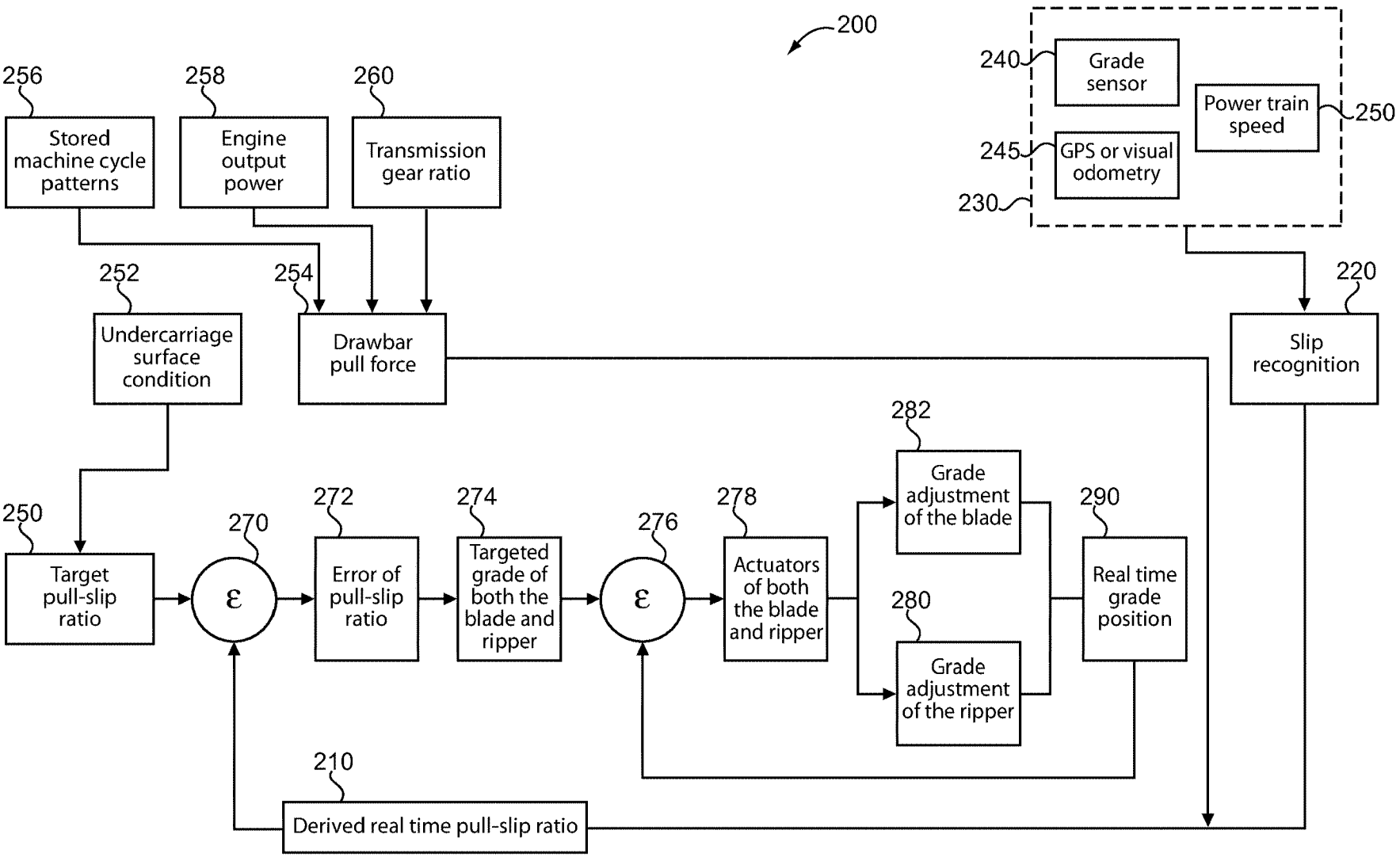
FIG. 8 is a control loop block diagram, according to one embodiment.

Referring now to FIG. 8, there is shown a block diagram 200 illustrating example calculations and computations in accordance with the present disclosure. At a block 210 a derived real time pull-slip ratio is received. The derived real time pull-slip ratio may be determined by way of a drawbar pull force 254 and also a slip recognition block or module 220 that detects track slip on the basis of a power train speed input 250, a grade sensor input 240, and a GPS or visual odometry input 245 in a slip parameters block 230. Comparisons between track speed and ground speed might also be used. At a block 250 a target pull-slip ratio is received based on an undercarriage surface condition 252 and drawbar pull force 254.

An undercarriage surface condition or undercarriage surface condition value can be determined based on estimated information from a work assignment system, or potentially from a neighboring machine by way of machine-to-machine communication systems. Real-time surface information can also be derived when a ripper is lowered down in a work position, in engagement with material of the underlying substrate, as discussed above. If the substrate surface is extremely slippery, when the ripper is lowered down, a track-type tractor may not be capable of moving at all. The ripper can be elevated to relieve the slip, and the height/grade of the ripper and the relative speed of the tractor utilized to derive the surface condition. On-board sensors monitoring ground speed, track speed, track slip, and other factors as discussed herein are employed for these purposes of gathering and storing data of the surface condition. Use of the ripper (implement 26) to derive a real-time pull-slip ratio is considered advantageous, as the information may be more accurate than information passed from other machines or from a work assignment system. Moreover, when a track-type tractor acquires the accurate real-time pull-slip ratio before a load phase by engaging the ripper at the end of a return phase, less time will likely be required for an autonomous machine to set an accurate grade for a blade when the load phase starts.

Drawbar pull force 254 may be computed on the basis of a transmission gear ratio 260, an engine output power 258, and stored machine cycle patterns 256, as described herein. Engine output power 258 might be estimated according to a fueling map and present engine speed. The stored machine cycle patterns could be based upon empirical testing of tractor operation under varying conditions, such as varying undercarriage or substrate conditions relating to moisture or soil hardness or toughness, for instance, slope or inclination conditions, and still others.

At a block 270 the derived real time pull-slip ratio 210 is compared with the target pull-slip ratio 250 to calculate an error value 272 corresponding to a pull-slip ratio error. At a block 274 a target grade of the blade/implement 24 and also a target grade of the ripper/implement 26 is determined, on the basis of the pull-slip ratio error 272. At a block 276 the target grades are compared with real time grade positions from a block 290, to produce actuator commands or control signals for actuators 26, 28, 29 or such other actuators as might be used, based on the error term calculated at block 276. Control signals may be sent to block 278, and the electrical currents for driving the appropriate actuators according to the control signals generated at a block 278. At block 282 grade adjustment of blade/implement 24 occurs and in parallel at block 280 grade adjustment of ripper/implement 26 occurs.

It should be appreciated that control mechanism 60, or another suitable control mechanism, receives data indicative of a grade of implement 26 and a grade of implement 24 at block 290, calculates the error between the indicated grades of each of implement 26 and implement 24 and target grades at block 276, and then reduces the errors by way of adjusting implement 26 and implement 24 in a closed loop fashion. Meanwhile the pull-slip ratio error calculated at block 270 is being reduced in a closed loop fashion. As described above, the reduction in the pull-slip error may be achieved by way of commanded engagement of implement 26 with material of the underlying substrate. It should also be appreciated, however, that the operation of tractor 10 may be changing at the same time, as the grade of implement 24 may be adjusted to transition tractor 10 between phases in a work cycle, such as between a load phase and a carry phase as depicted in FIG. 4. Accordingly, at each execution of the loop that reduces the pull-slip error, the target grade of implement 24 might be different. Where target grade of implement 24 is increasing, the reduction in effective drawbar pull attributable to implement 24 interacting with material of substrate 90 will be decreasing. Accordingly, the target grade of implement 26 to compensate for the decreasing reduction in drawbar pull attributable to increasing the grade of implement 26 may change. Since the manner in which implement 24 interacts with material of a substrate is different from the manner in which implement 26 interacts with material of a substrate, the changes in target grades of implement 26 and implement 24 may be different from one another. For instance, it may be necessary to lower implement 26 by a first amount or factor to compensate for raising implement 24 by a second amount or factor. The execution of the loop that controls actuator position(s) to reduce error between a grade of implement 24 and/or implement 26 may also occur more quickly than execution of the loop that limits the pull-slip ratio error.

Figure 9:
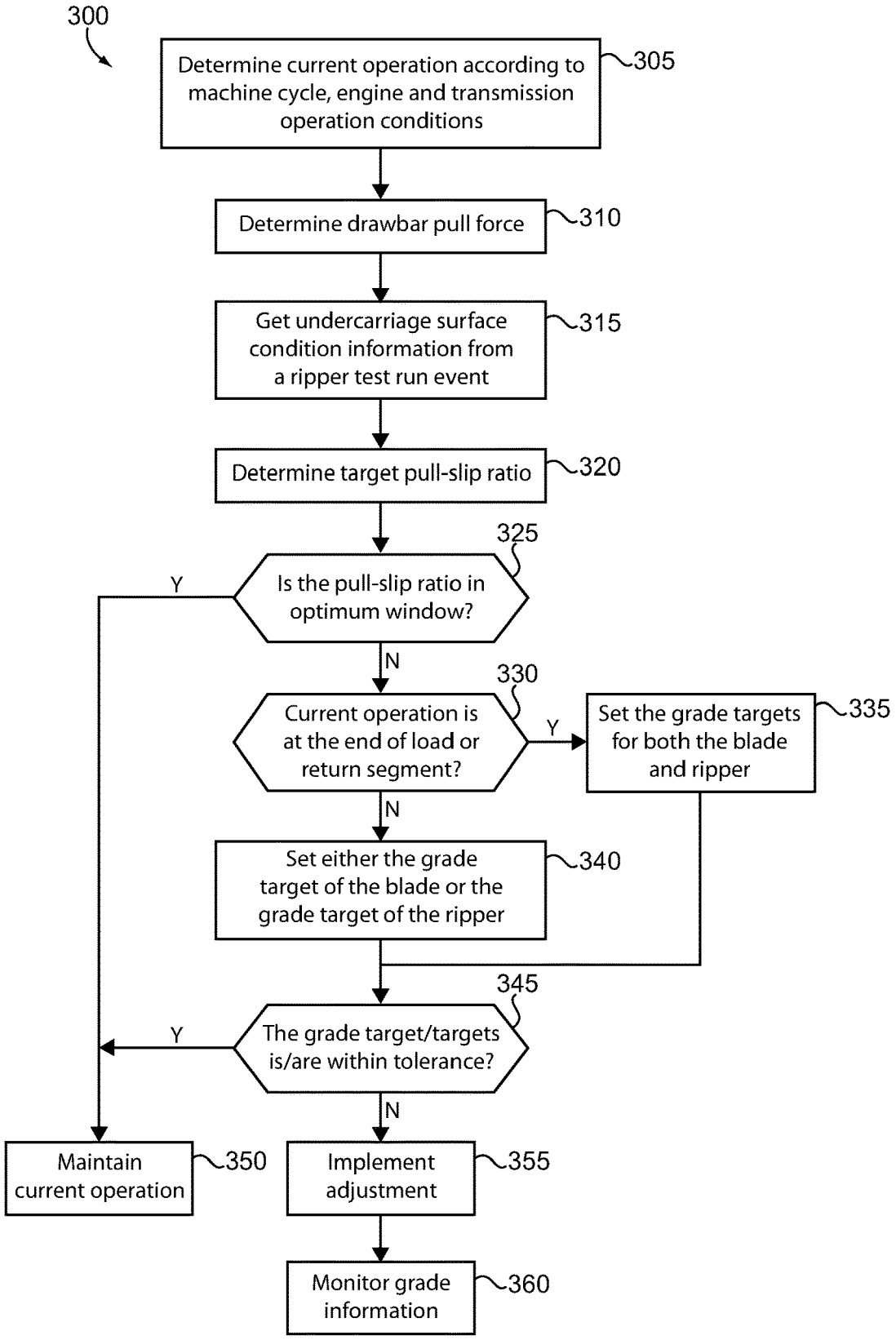
FIG. 9 is a flowchart of example pull-slip control logic, according to one embodiment.

Turning now to FIG. 9 there is shown a flowchart 300 illustrating example process and control logic flow, according to one embodiment. The logic flow may commence at block 305 to determine current operation according to machine cycle, and engine and transmission operation conditions. From block 305 the logic may advance to block 310 to determine drawbar pull force, and thenceforth to block 315 to get undercarriage surface condition information such as from a prior ripper test run event. It will be recalled that tractor 10 may be operated in a return phase of a work cycle to traverse a substrate with implement 26 engaged with the substrate for purposes of determining an undercarriage surface condition parameter, for example as depicted in FIG. 6. Embodiments are contemplated where tractor 10 performs multiple test runs across a surface of a substrate, possibly in forward travel directions and also reverse travel directions, to gather data that can be used to determine undercarriage surface conditions.

From block 315 the logic may advance to block 320 to determine the target pull-slip ratio. From block 320 the logic may advance to block 325 to query is the pull-slip ratio in the optimum window? If yes, the logic may advance to block 350 to maintain current operation. If no, the logic may advance to block 330 to query is the current operation at the end of load or return segment? If yes, the logic may advance to block 335 to set the grade targets for both the blade and the ripper. If no, the logic may advance to block 340 to set either the grade target of the blade or the grade target of the ripper. From either of block 335 or block 340 the logic may advance to block 345. At block 345 the logic may query whether the grade target or targets are within tolerance? If yes, the logic may advance to block 350 to maintain current operation. If no, the logic may advance to block 355 to adjust one or both of implement 24 and implement 26 as appropriate. From block 355 the logic may advance to block 360 to monitor grade information, and thereafter return to block 345, exit, or execute still another operation.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. As noted above, the teachings set forth herein are applicable to a variety of different traction-producing off-highway machines utilizing a variety of different implements than those specifically described herein. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A method of operating a tractor having a hydraulically actuated implement system, the method comprising:

receiving data indicative of a pull-slip ratio of the tractor during traversing a substrate with at least one of a front ground-engaging implement and a back ground-engaging implement of the hydraulically actuated implement system engaged with material of the substrate;

calculating an error between the pull-slip ratio indicated by the data and a target pull-slip ratio;

commanding engagement of the back ground-engaging implement with the material of the substrate to reduce the error between the pull-slip ratio indicated by the data and the desired pull-slip ratio;

wherein the front ground-engaging implement includes a blade and the back ground-engaging implement includes a ripper, and wherein commanding engagement further includes commanding varying a grade of the ripper; and receiving data indicative of a grade of the ripper, calculating an error between the indicated grade of the ripper and a target grade of the ripper, and reducing the error between the indicated grade of the ripper and the target grade of the ripper by way of the commanded engagement of the back ground-engaging implement.

2. The method of claim 1 further comprising initiating the commanded engagement of the back ground-engaging implement with the material of the substrate, such that an effective drawbar pull force of the tractor is reduced.

3. The method of claim 1 wherein commanding varying a grade of the ripper further includes commanding dropping the ripper from a first position where a tip of the ripper is vertically above a surface of the substrate, to a second position where the tip of the ripper is vertically below the surface of the substrate.

4. The method of claim 1 wherein the pull-slip ratio indicated by the data includes an expected pull-slip ratio, and further comprising initiating the varying of the grade of the ripper prior to occurrence of the expected pull-slip ratio.

5. The method of claim 1 wherein commanding engagement further includes commanding engagement of the ripper with the material of the substrate during transitioning the tractor from a load portion of a work cycle to a carry portion of a work cycle.

6. The method of claim 5 further comprising increasing a grade of the blade, during the transitioning of the tractor from the load portion of the work cycle to the carry portion of the work cycle.

7. The method of claim 1 further comprising commanding engagement of the ripper with material of the substrate during a return phase in a load, carry, spread, and return work cycle of the tractor, and monitoring a track slip parameter that is varied based on the commanded engagement of the ripper with material of the substrate during the return phase.

8. The method of claim 6 further comprising determining the target grade of the ripper based on the error between the pull-slip ratio indicated by the data and the target pull-slip ratio.

9. A tractor comprising:

a frame;

ground-engaging elements coupled to the frame;

a hydraulically actuated implement system including a front ground-engaging implement, and a back ground-engaging implement; and a pull-slip control system including a first sensing mechanism configured to monitor a drawbar pull parameter of the tractor, a second sensing mechanism configured to monitor a slip parameter of the tractor, and a control mechanism coupled with the hydraulically actuated implement system;

the control mechanism being configured to:

compare a pull-slip ratio indicated by data produced from the first sensing mechanism and the second sensing mechanism with a target pull-slip ratio;

command engagement of the back ground-engaging implement with material of the substrate, such that an error between the pull-slip ratio indicated by the data and the target pull-slip ratio is reduced;

wherein the front ground-engaging implement includes a blade, and the back ground-engaging implement includes a ripper; and wherein the control mechanism is further configured to calculate the error between the pull-slip ratio indicated by the data and the target pull-slip ratio, and to determine a target grade of the back ground-engaging implement based on the error.

10. The tractor of claim 9 wherein the control mechanism is further configured by way of commanding of the engagement to drop the ripper to reduce an effective drawbar pull force of the tractor.

11. The tractor of claim 10 wherein the control mechanism is further configured to limit overspeeding an engine in a powertrain of the tractor by way of the dropping of the ripper.

12. The track-type tractor of claim 9 wherein the control mechanism is further configured to determine the target pull-slip ratio based on the drawbar pull parameter and an undercarriage surface condition parameter.

13. A pull-slip control system for a tractor having a hydraulically actuated implement system with a front ground-engaging implement and a back ground-engaging implement, the pull-slip control system comprising:

a first sensing mechanism configured to monitor a drawbar pull parameter of the tractor;

a second sensing mechanism configured to monitor a track slip parameter of the tractor;

a control mechanism, the control mechanism being configured to:

receive data from each of the first sensing mechanism and the second sensing mechanism;

determine a pull-slip ratio of the tractor based on the data received from the first sensing mechanism and the second sensing mechanism;

compare the determined pull-slip ratio with a target pull-slip ratio; and command engagement of the back ground-engaging implement with material of a substrate underlying the tractor, such that an error between the pull-slip ratio indicated by the data and the target pull-slip ratio is reduced;

wherein the control mechanism is further configured to command the engagement by commanding dropping the back ground-engaging implement from a first position vertically above a surface of the substrate to a second position vertically below the surface of the substrate; and wherein the back ground-engaging implement includes a ripper, and wherein the control mechanism is further configured to:

receive data indicative of a grade of the ripper;

calculate an error between the grade of the ripper indicated by the data and a target grade of the ripper; and reduce the error between the indicated grade of the ripper and the target grade of the ripper by way of the commanded engagement of the back ground-engaging implement.

14. The control system of claim 13 wherein the control mechanism is further configured to determine the target pull-slip ratio based at least in part upon the drawbar pull parameter and an undercarriage surface condition.

* * * * *